United States Patent [19]

Capawana

[11] 4,385,481

[45] May 31, 1983

[54] METHOD AND APPARATUS FOR DELIVERING COINS TO COIN-WRAPPING MACHINES

[76] Inventor: Ross Capawana, 2960 Westwood Dr., #23, Las Vegas, Nev. 89109

[21] Appl. No.: 246,609

[22] Filed: Mar. 23, 1981

[51] Int. Cl.[3] ..... G07D 3/04

[52] U.S. Cl. ..... 53/461; 53/504; 133/3 F

[58] Field of Search ..... 53/212, 504, 461; 133/3 F, 8 E, 1 R, 8 A, 3 H, 3 D, 3 C, 3 B, 3 E; 194/99, 102

[56] References Cited

U.S. PATENT DOCUMENTS 1,553,979 9/1925 Bryk ..... 133/3 F 3,126,081 3/1964 Dolman ..... 194/102

*Primary Examiner*—Stanley H. Tollberg

*Attorney, Agent, or Firm*—Seiler & Quirk

[57] ABSTRACT

A transporting system to deliver coins to coin-processing machines includes a single endless belt mounted above the coin-processing machines. The belt is mounted horizontally, with the coin-carrying belt surface canted at a 45° angle to horizontal to form a V-shaped trough with an adjacent wall along which coins are carried. A plurality of ports having adjustable gates permit coins to fall through chutes to the processing machines. Coins passing all of the ports drop into a hopper, and are recirculated to the endless belt by a conveyor.

9 Claims, 7 Drawing Figures

METHOD AND APPARATUS FOR DELIVERING COINS TO COIN-WRAPPING MACHINES

BACKGROUND OF THE INVENTION

This invention relates to equipment and methods for conveying coins from one location to another. In particular, it concerns methods and apparatus for delivering coins to a plurality of coin-wrapping machines.

Coin-wrapping machines are commonly used by banks, casinos, and other businesses which handle very large quantities of coins. A number of wrapping machines are commercially available; for example, the Standard Rasant machine manufactured by Standardwerk Eugene Reis GMBH, Germany, is described basically in Puhahn, U.S. Pat. No. 3,825,300. These wrapping machines operate extremely rapidly, and may wrap up to about one roll of coins each second. While many different varieties of machines are available, virtually all of the models have a hopper located at an upper portion of the machine into which coins are dumped, and are fed from the hopper by gravity to the stacking and wrapping mechanisms of the apparatus.

It is not uncommon for some facilities to wrap in excess of one million coins in one day. A formidable materials-handling problem is encountered, particularly in view of the fact that it may frequently be necessary to shift from the wrapping of coins of one denomination to coins of another denomination, e.g., from quarters to nickels. Accordingly, it is common for bank, casino, or the like to employ a plurality of wrapping machines to handle the large number and variety of coins to be wrapped.

To facilitate delivery of the coins to the wrapping machines, various conveyor systems to move coins from a central location to the wrapping machines have been devised. For example, a constantly recirculating system comprising a pair of canted endless conveyor belts which act to circulate coins around a closed path having discharge chutes for feeding various coin wrapping machine-hoppers is disclosed in Black et al, U.S. Pat. No. 3,860,017. In this system, coins travel continuously on one of two generally horizontal belts until they fall into a chute leading to a wrapping machine. No provision is made in the Black et al system for returning the coins circulating on the belt to the original source in the event that a rapid change to a different coin denomination is required. Additionally, if a portion of the system (e.g., one or more wrapping machines) experiences a breakdown, the coins will continue to accumulate on the two endless belts, and will eventually overload.

It is an object of the present invention to provide a coin conveyor system for moving coins from a central large hopper to a plurality of wrapping machines which is relatively simple and can operate with little or no supervision, and which is adaptable to a variety of coin supply situations. It is a further object of the invention to provide a coin conveyor system which will deliver coins as required to a plurality of wrapping machine hoppers, without overloading the hoppers, and which will return coins which have not been fed to the wrapping machine hopper to a central location. It is a further object of the invention to provide coin conveying apparatus having take-off chutes which may be operated fully open, fully closed, or at any intermediate position, to adjust the rate of coin supply to the chute according to machine requirements. These and other objects of the invention will be apparent to one skilled in the art from the following detailed description of a specific embodiment of the invention.

SUMMARY OF INVENTION

A system for delivering coins to coin-processing machines comprises a coin hopper, means for transferring coins from said hopper to a lower portion of an elevating conveyor, a single endless belt traversing a substantially horizontal path, said belt and elongated wall member forming a "V" shaped trough along which coins are carried, a plurality of chutes depending from said elongated walls, ports at the top of said chutes communicating with said trough, and means for adjustably opening and closing said ports to control the flow of coins from the trough into each chute.

BRIEF DESCRIPTION OF THE DRAWINGS

The invention is best understood with reference to the drawings depicting a specific embodiment of the invention, in which.

DETAILED DESCRIPTION OF A PREFERRED EMBODIMENT

Figure 1:
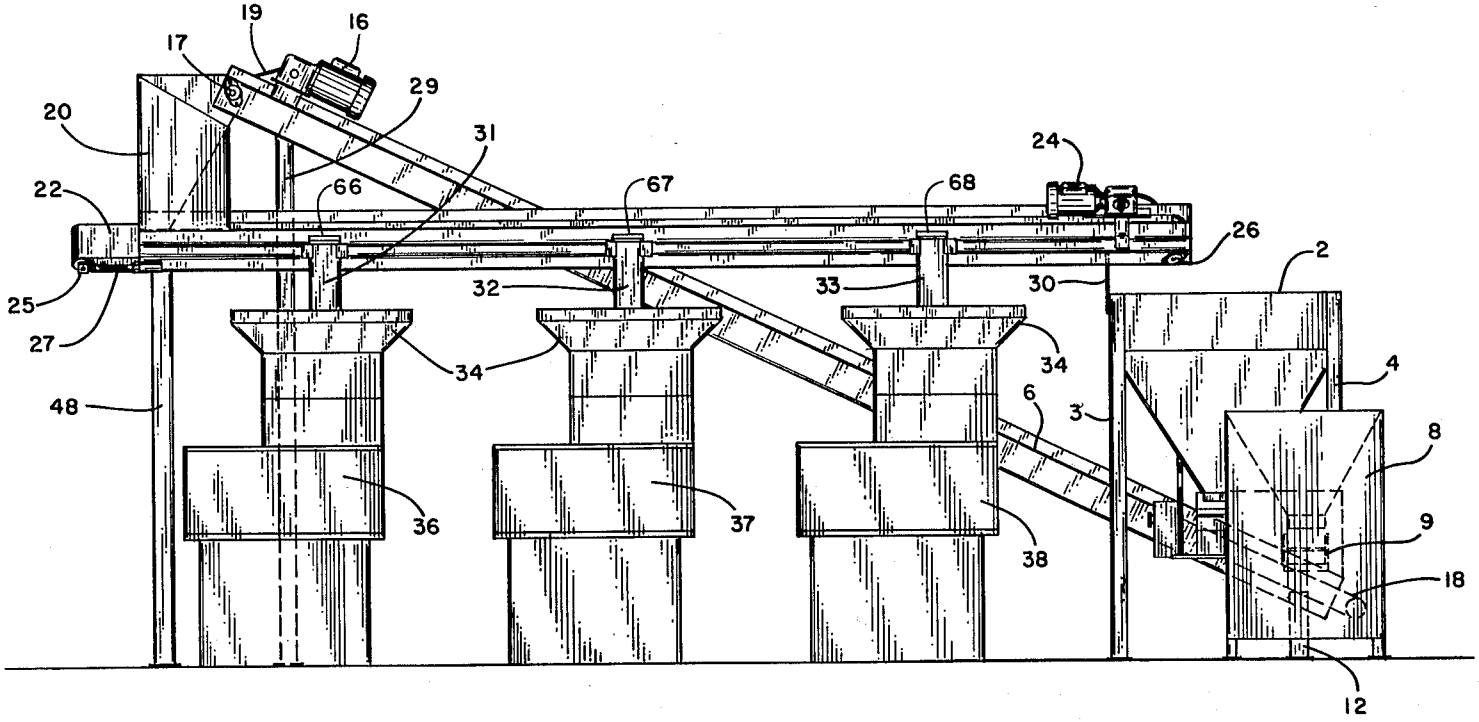
FIG. 1 is a side elevational view of a coin processing system of the invention.
Figure 3:
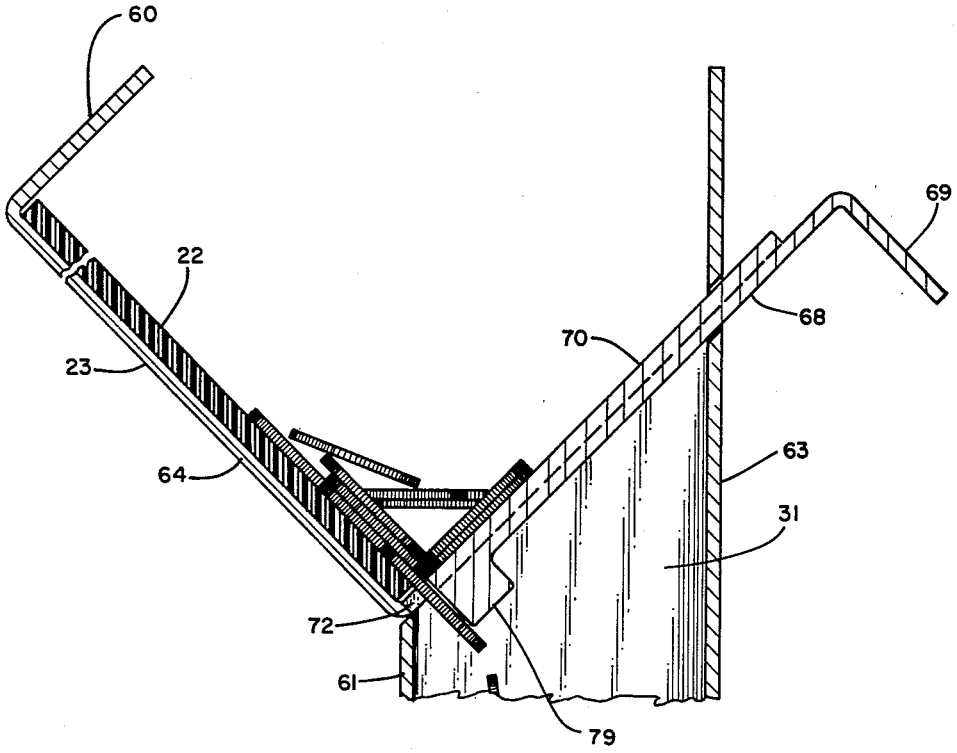
FIG. 3 is a partial section view of the canted belt, gate, and delivery chute showing the gate opened sufficiently to permit one width of coin to pass.
Figure 4:
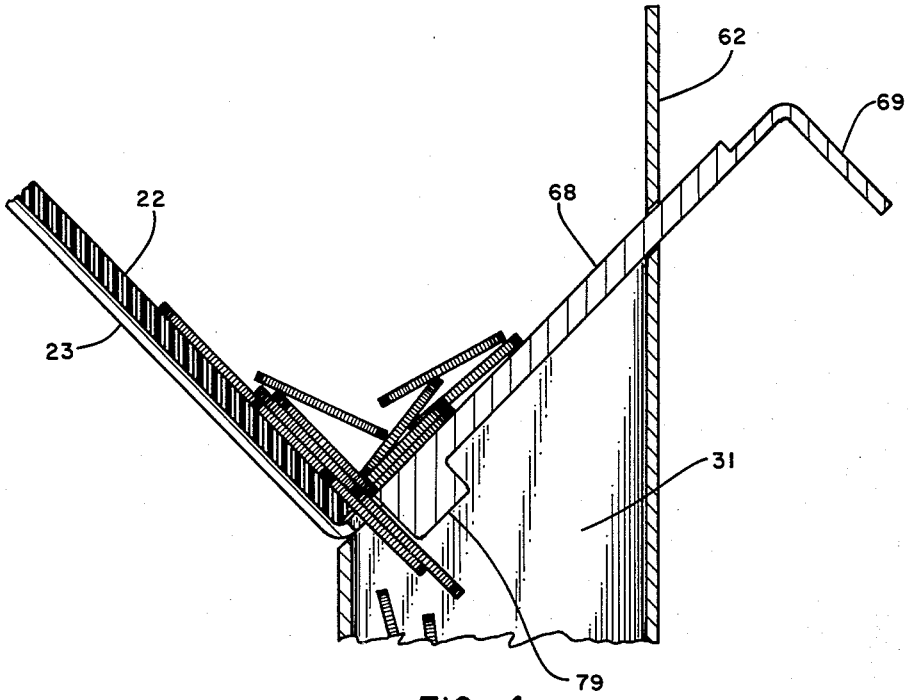
FIGS. 4 and 5 are views similar to 3 with the gate being opened to different degrees.
Figure 5:
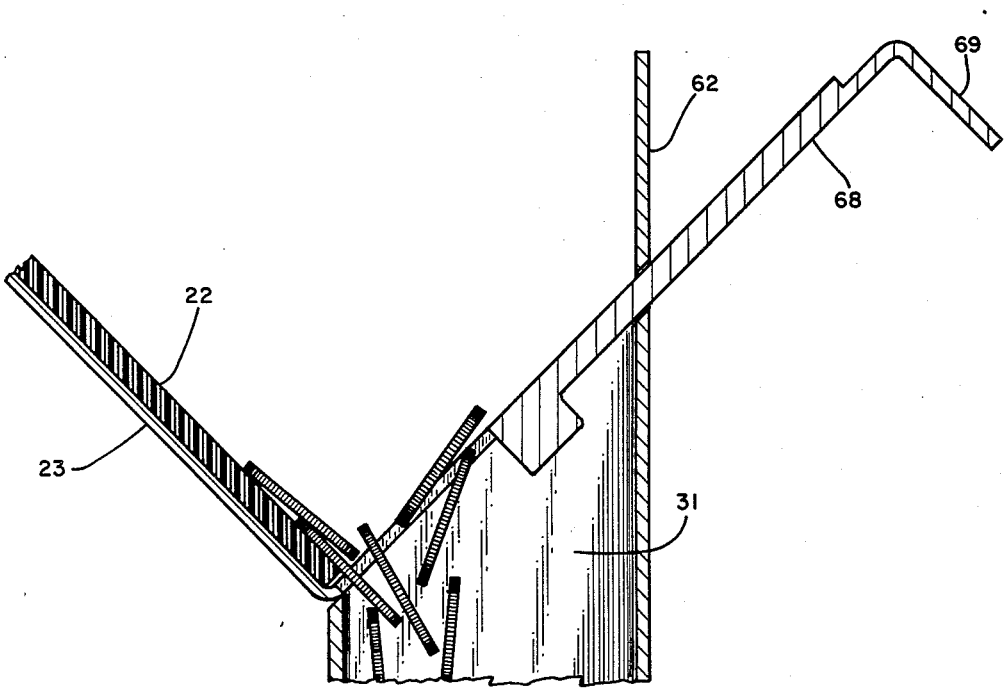

Referring to FIG. 1, the basic elements of the coin supply system shown are a remote supply hopper 8, a circulating coin hopper 2, an elevating conveyor 6, a horizontal endless belt conveyor 22, and three wrapping machines 36, 37, 38. While the system is described as feeding wrapping machines, it will of course feed any type of coin processing machine, and can easily be adapted to feed any number of machines. In operation of the system, a scale (not shown) dumps a pre-weighed quantity of coins into the remote supply hopper, which feeds the coins to a lower portion of an elevating endless belt conveyor 6. Coins travel upwardly on the conveyor to a chute 20, through which the coins fall by gravity onto a canted horizontal endless belt 22. Coins travel along the belt conveyor and are selectively dropped into the wrapping hoppers. Coins pass gates 66, 67, and 68 and pass chutes 31, 32, and 33 respectively into the hoppers 34 of the three wrapping machines. Control of the flow through the gates is shown in FIGS. 3, 4, and 5, and discussed subsequently. Coins which pass all of the wrapping machine feed chutes continue along the horizontal conveyor and fall by gravity off the end of conveyor 22 into circulating coin hopper 2.

The remote supply hopper 8 may be mounted parallel to or at right angles to the elevating conveyor. This hopper is a small, easily portable device having a relatively low hopper opening, thereby affording easy access for dumping coins which have been weighed on a scale. Coins exit at a lower portion of the hopper and drop on to a horizontal endless-belt feed conveyor 13.

The endless belt extends around roller 11 and a similar roller (not shown) at its opposing end, and is mounted in a U-shaped shield 9 which prevents coins from falling off the belt. Details of the remote supply hopper-feed system, which are well-known and commercially available and form no part of the invention, are not shown.

Coins are conveyed in an endless belt 10 from the remote supply hopper to a lower portion of an elevating conveyor 6. The elevating conveyor may be of any type, but is preferably also an endless belt conveyor, which may be cleated if desired to prevent sliding of the coins along the conveyor. The elevating conveyors supported at its base by a frame 12, and at its upper end by frame 29. The elevating conveyor belt 14 (shown in FIG. 7) is driven by an electrical motor 16 through a reducer 15, and extends between drive roller 17 and passive roller 18 located at the upper and lower portions of the conveyor, respectively. Drive chain 19 extends between the gear reducer and the roller and forms a portion of the drive means.

Coins drop from the upper end of the elevating conveyor through a chute 20 on to a horizontal conveyor comprising an endless belt 22 for delivery to the wrapping machine. The endless belt is canted at a 45° angle to horizontal, with the coins sliding down the belt into a V-shaped trough formed between belt 22 and an elongated side wall 59 of the belt frame. Coins sliding down the belt generally attain a somewhat random configuration as shown in FIG. 3. If desired, the belt may be canted at a different angle, e.g. from 30°–60° from horizontal, but about 45° is preferred.

Figure 6:
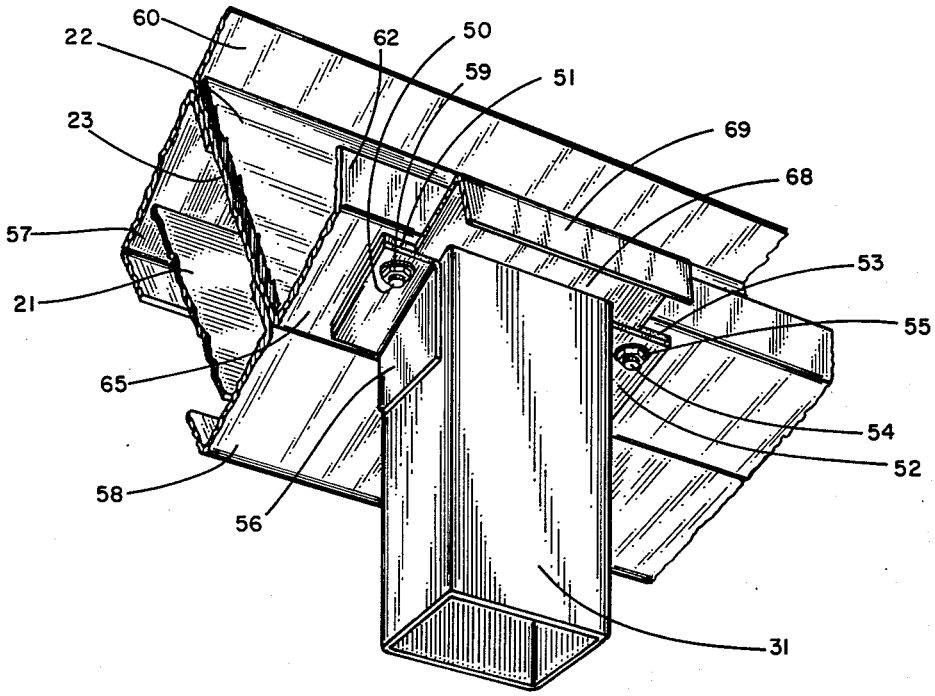
FIG. 6 is a partial perspective view of the endless belt support construction, gate, and delivery chute.
Figure 7:
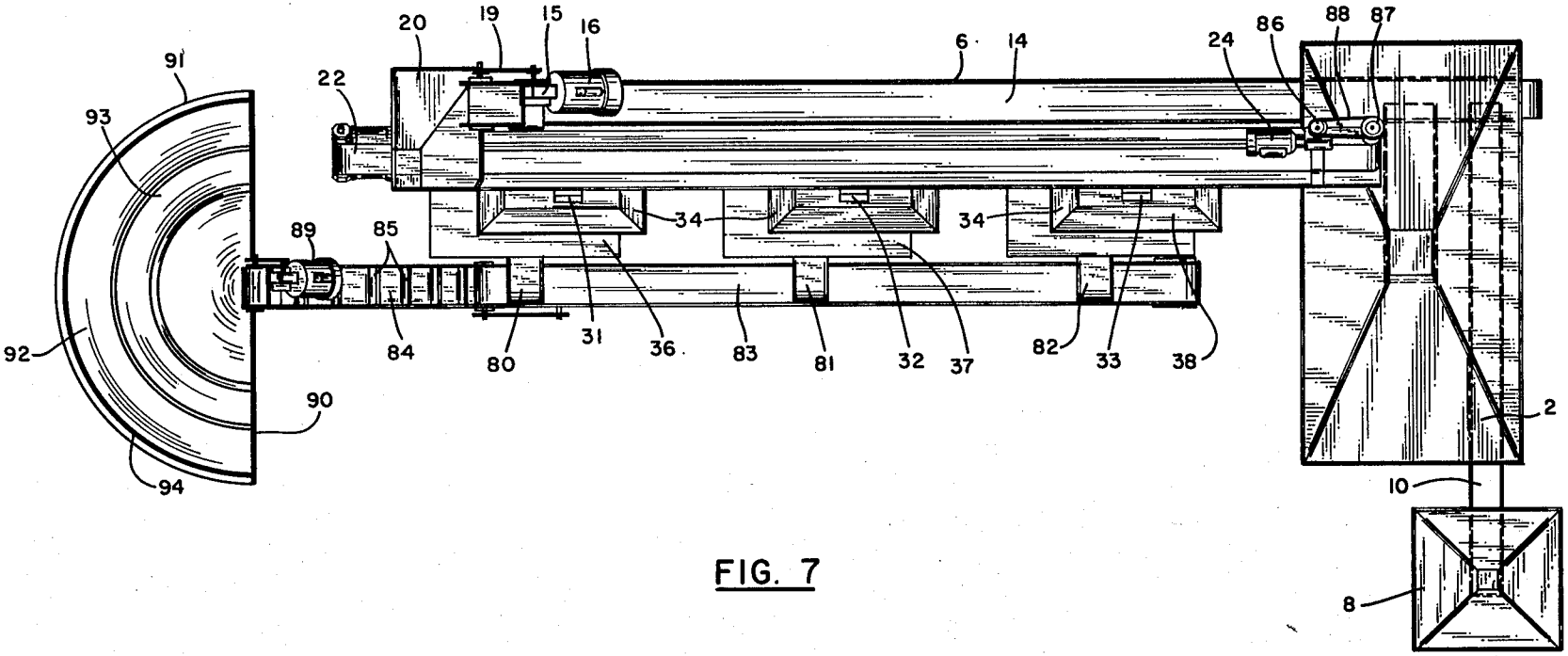
FIG. 7 is a top view of a coin processing system according to the invention including all elements from a weighing hopper to a wrapped coin collection table.

The horizontal belt conveyor is supported at its rearward end by ground-mounted leg 48, and at its forward end by a strut 30 which extends between the conveyor and the side wall of circulating coin hopper 2. The belt revolves around roller 25 which is mounted on an extension bracket 27, and roller 26 at the forward end of the conveyor. The conveyor is powered by drive motor 24. Additional portions of the belt drive means, including gears 86 and 87 and drive chain 88, are shown in FIG. 7. A partial view of the conveyor housing is shown in FIG. 6. Belt 22, having its return section 21, traverses a fixed elongated substantially U-shaped shield 23, which has a rear wall 60 and a front wall 65 extending at right angles from a flat floor portion 64 which is traversed by the belt. The shield has a front flange portion 62 which extends upwardly at a 45° angle to the front wall. The belt shield 23 is mounted on a pair of U-shaped beam members 57 and 58, which also partially enclose the return section 21 on the endless belt.

A particularly important part of the invention is the coin take-off means which generally comprises the chutes 31, 32, and 33 which communicate with the V-shaped trough formed by the endless belt in wall 65 through a plurality of openings in the wall (see opening 72 in FIG. 3) which are adjustably closeable by means of sliding gates 66, 67, and 68, respectively. Details of construction of the chute and gate are shown in perspective in FIG. 6, and in side section in FIG. 3. Chute 31 has a pair of flanges 52 and 56 welded to opposing sides for attachment to the belt shield. The outwardly extending flanges are attached by bolts 54 and 62, and nuts 55 and 59 to the shield wall. Spacer strips 51 and 53 are employed to separate the upper of the chute from the shield sufficiently to enable the gate 68 to move slideably upwardly and downwardly across the top of the chute, thereby varying the size of the opening into the chute. A downwardly extending flange 69 on the gate forms a handle by which the gate is moved.

As best seen in FIG. 3, the gate 68 consists of a sheet metal member 68 having a handle portion 69 and a stop member comprising a rib 79 along its bottom end which precludes withdrawal of the gate completely from the upper portion of the chute. The gate has a forwardly protruding wall 70 on its forward portion which when the gate is closed, is coextensive with the front wall 65 of the belt shield. A slot or opening is cut at the upper portion of each chute in wall 65, and plate 70 opens and closes the slot as the gate is lifted and lowered, thereby permitting coins to fall by gravity through the opening in the wall and into the chute as shown in FIGS. 3, 4, and 5. The chute has front and rear walls 63 and 61, respectively.

Coins which are carried past chutes 31, 32, and 33 reach the forward end of the horizontal endless belt and drop into circulating coin hopper 2. This hopper is floor-mounted by means of legs at each corner thereof, three of which are designated in the drawings as members 3, 4, and 5. This hopper is used for recirculation of the coins to the supply mechanism, and to receive and store excess coins. In some circumstances, the remote supply hopper 8 may be unnecessary, and incoming coins can be dumped directly into the recirculating coin hopper.

Figure 2:
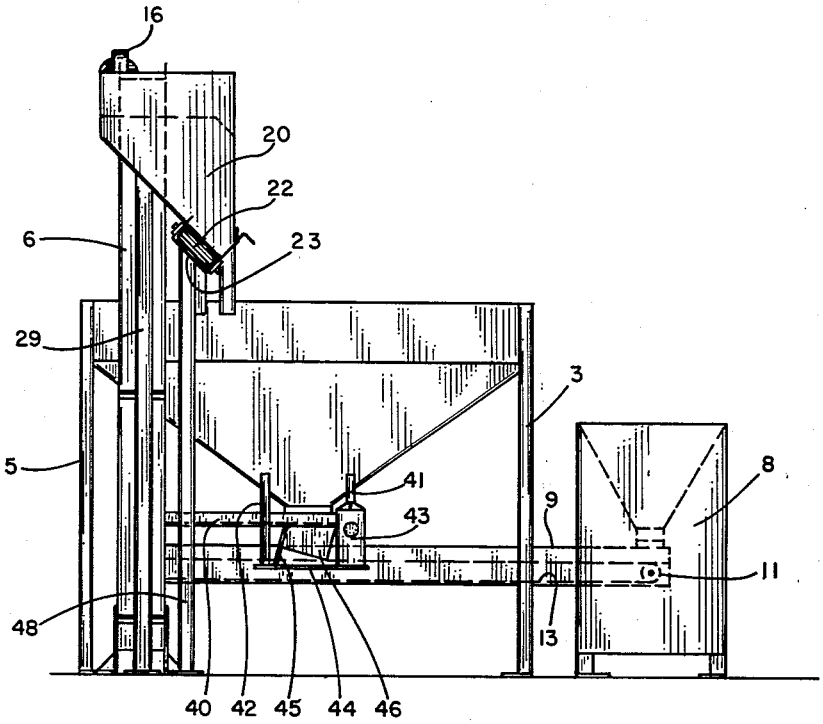
FIG. 2 is an end view of the system shown without the wrapping machines in place.

As best seen in FIG. 2, a vibrating coin feed assembly is mounted below the exit of hopper 2 on a shelf 44 which is attached to the hopper by means of four welded mounting legs, two of which are shown as members 41 and 42. A vibrating motor 42 mounted on front leg 45 vibrates a horizontal chute 40 in such a manner that coins travel along its length, thereby eventually dropping on a lower portion of the elevating conveyor 6. The vibrating feeder is a conventional, commercially available device e.g., the FMC Syntron Vibratory Feeder model F-T01. The motor is controlled from switch box 43.

Accordingly, a complete loop is formed for travel of the coins through the system, with coins not being received by a wrapping machine automatically returning to the recirculating coin hopper. In the event of a breakdown of one or more coin wrapping machines, which is a not infrequent occurrence, the coins would return to the recirculating hopper, which is sufficiently large to accommodate all of the coins traveling in the system.

The height of the chutes 31, 32, and 33 is arranged such that the bottom of the chute extends approximately to the level of the top of the hopper 34 at the upper portion of each wrapping machine. If desired, these chutes could be made adjustable in length by the addition of a telescoping section. As coins pour through the chutes into the wrapping machine, the hoppers 34 fill up. When the level of coins in the hopper reaches the bottom of the chute, coins will no longer fall through into the hopper and will pile up in the chute, thereby effectively closing the opening to the chute. At this point, the chute will receive no more coins, and the coins will continue down the conveyor to the next available chute, or to the recirculating hopper.

FIGS. 3, 4, and 5 depict actual operating conditions when the chutes gates are opened to varying degrees. As coins are dropped through hopper 20 onto the canted belt, the coins gravitate down randomly into a configuration as shown in FIG. 3, and are dragged along by friction by moving belt 22. The coins also roll or slide along the inner surface of wall 65. A number of coins are observed to lie flat on the belt, while others will lie flat along wall 65, at right angles to the first set of coins. In an operating situation which desires only a relativly small number of coins to flow into the chute, the gate is opened sufficiently to only approximately one coin width. At this point, only the bottom layer of coins lying flat on the endless belt will drop by gravity into the chute; other coins will continue on down the belt. If the gate is opened slightly wider, e.g., to accommodate two coin widths as shown in FIG. 4, then the bottom two layers of coins lying flat on belt 22 will slide by gravity through the opening, and the remainder of the coins will continue down the belt. In the condition shown in FIG. 5, with the gate being wide open, substantially all of the coins approaching the chute will be captured until the chute is filled. In a typical continuous operating situation, the first gate 66 might be open to the width of e.g. one coin, gate 67 would be open to a width of two or three coins, and the final gate 68 would be completely open as shown in FIG. 5. Similar adjustments would be made if more machines, e.g. 6 or 8, were used. This operating condition would permit each of the coin-wrapping hoppers to fill at approximately the same rate; once any of the hoppers were full, the chute would fill up, thereby effectively closing the slot in wall 65 and precluding any additional coins from dropping into the chute. At this time, additional coins approaching the gate would simply continue down the conveyor. As coins were drawn down in the wrapping machine, coins stacked up in the chute would drop into the hopper, unplugging the chute and permitting additional coins to fall through the slot and into the chute. In the event that any of the wrapping machines need replacement or service, the gates are easily manually closed permitting isolation of the machine from the feed system. In the event of a breakdown of the wrapping machines, or of an overloading of coins into the feed system, the excess coins simply return to the circulating hopper by dropping off the end of the horizontal conveyor.

A preferred utility for the system of the invention is shown in FIG. 7. Coin rolls exiting wrapping machines 36, 37, and 38 drop down rolled coin discharge chutes 80, 81, and 82 on to a horizontal conveyor belt 83. They are transported to an elevating conveyor belt 84 having cleats 85 to prevent the rolled coins from rolling backward down the belt. The elevating rolled coin conveyor 84, driven by motor 89, deposits the coin rolls on a canning or boxing table 91. This table has the shape of a semi-cone, with its apex just under the top of the elevating conveyor. Coin rolls then roll randomly down the surface 92 of the cone, resting at a shelf 94 at its bottom edge. The table also has an upper shelf 93 of semi-frustoconical shape which is mounted above the surface of the canning table, and which holds cans or boxes into which the rolled coins are placed. It is readily seen that the entire coin supply system is mechanized completely, with loose coins being dumped in one end of the system and rolled, stacked coins being removed from the downstream end of the system.

The invention is not limited with regard to the particular orientation of the system components. For example, in FIGS. 1 and 2 the small hopper 8 is offset from the elevating conveyor, and feeds the elevating conveyor at right angles thereto. However, the feed conveyor and hopper can easily be oriented parallel to the elevating conveyor. Similarly in FIG. 7 the cleated belt conveyor and canning table may be oriented perpendicularly to the rolled coin conveyor.

While the drawings show a system designed to accommodate three coin wrapping machines, the invention is not so limited and can obviously be used to service substantially more than three machines. In addition, the system shown in the drawings can be easily adapted for use with one or two machines simply by closing one or two of the gates to the chutes.

Various types of adjustable gates may also be used in place of the sliding gate described herein. For example, excellent results have been obtained using a gate which is hingedly connected to the front flange shield 62 and which opens outwardly away from the shield and the belt 22. Frictional resistance built into the hinge maintains the opening of the gate at the desired level.

In addition, the system of the invention is easily adaptable to a rapid changeover from one denomination of coin to another. As the coin supply is depleted, the gates to the wrapping-machine chutes are shut off, and the wrapping machines then deplete the coins in each of their hoppers 34. Any extra coins remaining on the conveyor would return to the recirculating coin hopper, from which they are easily removed. A new coin denomination is then dumped into the remote supply hopper 8, (or into the recirculating hopper) for circulation through the system. When the supply hoppers 34 are empty of coins of the first denomination, the gates may be re-opened to the desired extent to permit the wrappers to handle the new denomination of coins. Once the new coins are in the system, the system need not be monitored.

I claim:

1. A system for conveying coins to a plurality of coin processing machines comprising a circulating coin hopper, a single, elevated, substantially horizontally mounted endless-belt conveyor, said belt having a coin-conveying surface canted at an angle to horizontal, transporting means for moving coins from the hopper to the belt conveyor, a housing for said belt conveyor having a wall means extending along said belt, said wall means and said belt forming a V-shaped trough, a plurality of spaced openings in said wall means, and gate means for adjustably closing said openings.

2. The system of claim 1 wherein the coin-conveying surface of the belt is canted at an angle of from about 30° to about 60° from horizontal.

3. The system of claim 1 wherein a coin exit portion of the V-shaped trough is located above the circulating coin hopper such that coins reaching said exit portion move by gravity to the circulating coin hopper.

4. The system of claim 1 also comprising a plurality of chutes depending from the spaced openings for guiding coins falling therethrough to coin processing machines.

5. The system of claim 1 comprising a plurality of circulating coin hoppers.

6. The system of claim 1 also comprising a plurality of coin wrapping machines, means for transporting wrapped coins from the coin-wrapping machines, and stacking means for retaining wrapped coins.

7. A method of conveying coins to a plurality of coin processing machines comprising (1) conveying coins from a storage hopper to a lower portion of an elevating conveyor, (2) transferring coins from an upper portion of the elevating conveyor to a substantially horizontally mounted conveyor belt having a coin conveying surface canted at an angle of horizontal.

(3) moving coins along the belt to a plurality of a coin takeoff means, (4) selectively adjusting each coin takeoff means to remove coins from the conveyor belt at a desired rate, (5) delivering coins by gravity flow through one or more takeoff means to coin processing machines, and (6) returning coins passing all takeoff means to the storage hopper by gravity flow.

8. Coin distributing apparatus comprising a frame, an elongate horizontal V-shaped trough mounted on the frame formed by two walls, coin transporting means consisting of a flat endless belt having a lower surface longitudinally traversing one of said walls, and an upper coin-transporting surface substantially inclined from horizontal, a plurality of spaced openings in the other of said walls communicating with said trough, and gate means for independently adjustably closing each of said openings, said belt adapted to move coins along the lower portion of said V-shaped trough past one or more of said openings.

9. The coin distributing apparatus of claim 8 also comprising chute means extending downwardly from each wall opening.

* * * * *